US010176670B2

(12) United States Patent
Hsu

(10) Patent No.: US 10,176,670 B2
(45) Date of Patent: Jan. 8, 2019

(54) ENTERTAINMENT SYSTEM HAVING PRIZE MONEY GAME

(71) Applicant: Tien-Shu Hsu, Taichung (TW)

(72) Inventor: Tien-Shu Hsu, Taichung (TW)

( * ) Notice: Subject to any disclaimer, the term of this patent is extended or adjusted under 35 U.S.C. 154(b) by 0 days.

(21) Appl. No.: 15/612,307

(22) Filed: Jun. 2, 2017

(65) Prior Publication Data

US 2017/0270749 A1 Sep. 21, 2017

Related U.S. Application Data

(63) Continuation-in-part of application No. 14/808,599, filed on Jul. 24, 2015.

(30) Foreign Application Priority Data

Oct. 7, 2014 (TW) ..... 103134847 A

(51) Int. Cl.
*G07F 17/32* (2006.01)

(52) U.S. Cl.
CPC ..... *G07F 17/3244* (2013.01); *G07F 17/3209* (2013.01); *G07F 17/3211* (2013.01); *G07F 17/3267* (2013.01); *G07F 17/3288* (2013.01)

(58) Field of Classification Search
None
See application file for complete search history.

(56) References Cited

U.S. PATENT DOCUMENTS

| | | | | |
|---|---|---|---|---|
| 9,319,357 | B2 * | 4/2016 | Moyers | H04L 51/04 |
| 2002/0055381 | A1 | 5/2002 | Tarantino | |
| 2004/0087357 | A1 | 5/2004 | Johnson | |
| 2008/0207313 | A1 | 8/2008 | Acres | |
| 2008/0214292 | A1 | 9/2008 | Bryant et al. | |
| 2009/0247290 | A1 * | 10/2009 | Inamura | G07F 17/3258 463/27 |
| 2013/0102372 | A1 | 4/2013 | Lutnick et al. | |
| 2013/0225264 | A1 * | 8/2013 | Yamauchi | G07F 17/32 463/25 |
| 2013/0225265 | A1 * | 8/2013 | Yamauchi | G07F 17/32 463/25 |

* cited by examiner

*Primary Examiner* — Ronald Laneau
(74) *Attorney, Agent, or Firm* — Muncy, Geissler, Olds & Lowe, P.C.

(57) ABSTRACT

An operation input interface includes multiple selection buttons for a player to play a prize money game, and an information output interface includes multiple selection items comprising hidden contents and positions associated with the selection buttons. The hidden contents of the selection items include multiple rewards and at least one ending option. After the prize game starts, the selection items and the selection buttons are respectively provided at the information output interface and the operation input interface to allow the player to select the selection buttons to further display the hidden contents. When any of the at least one ending option is displayed by the information output interface, the prize money game ends immediately. Thus, the player is allowed to play the prize money game intuitively, and provides the player with the pleasure of ending the prize money game unexpectedly by ending the prize money game randomly.

26 Claims, 16 Drawing Sheets

ENTERTAINMENT SYSTEM HAVING PRIZE MONEY GAME

This application is a continuation-in-part, and claims priority, from U.S. patent application Ser. No. 14/808,599 filed on Jul. 24, 2015, entitled "WINNING GAME SYSTEM", the entire contents of which are hereby incorporated by reference.

FIELD OF THE INVENTION

The present invention relates to a prize money game, and particularly to an operating system of a prize money game.

BACKGROUND OF THE INVENTION

A prize money game is an additional reward provided by a game system, and may be randomly generated or entered once conditions set by the game system are satisfied. A characteristic of the prize money game is that, the game can be played without placing any bet and a certain amount of prize money can be won at no cost, hence allowing a player to obtain the prize money and providing the player with a sense of getting a free lunch. Therefore, in general, prize money games help a game system to attract players to play, in a way that a utilization rate of the game system is increased.

A conventional prize money game is a small, independent game outside a game system, and usually provides a fixed game timing or game number to allow a player to play within the fixed game timing or game number to obtain points. The points of the game are then converted to an equal amount of prize money that is then given to the player.

However, such conventional prize money game may be considered merely another game system with different rules. From perspectives of a player, the player may not be strongly attracted if playing rules of a prize money game are too monotonous. What the player values most is gaining free and additional prize money although the player may not have any interest in playing. In this case, the enjoyment of the player is obviously diminished. On the other hand, some folk prize money games that have been designed may have much too complicated playing rules or a too time-consuming playing process, and may pose burden on a game thinking process of the player. Further, as the player wishes most to get the prize money, if the player gets just one of numerous prize money items originally expected to get after spending a lengthy period of time playing the prize money game, a game pace of the player on the game system and a rhythm of "striking the iron while it's hot" may be disrupted. As a result, the player usually plays prize money games at random. When the player feels bored, the interest of the player continuing playing the game system is also affected, leading to a lowered utilization rate of the game system.

SUMMARY OF THE INVENTION

It is an object of the present invention to disclose an entertainment system having a prize money game. The entertainment system allows a player to play a prize money game in an intuitive way without having to learn playing rules, and randomly arranges a schedule of playing the prize money game to provide the player with an unexpected playing rhythm. In addition to prize money, the entertainment system further offers the player with a pleasure of selecting and gaining an addition reward to boost the interest in playing.

To achieve the above object, the present invention provides an entertainment system having a prize money game that allows a player to place a bet on the entertainment system and obtain game prize money after triggering a prize money game. The entertainment system having a prize money game includes a user interface and an operation processing unit. The user interface includes an operation input interface and an information output interface. The operation input interface includes a betting module for the player to place a bet, and a plurality of selection buttons for the player to play the prize money game. The information output interface includes a plurality of selection items having hidden contents and positions associated with the selection buttons.

The operation processing unit is electrically connected to the operation input interface and the information output interface, and includes a determination process, an accumulation process and a prize money calculation and payout process. The operation processing unit performs steps of:

a) determining by the determination process whether the prize money game is triggered, and defining the hidden contents of the selection items to include a plurality of rewards and at least one ending option after the prize money game is triggered;

b) displaying the selection items on the information output interface, and activating the selection buttons at the operation input interface;

c) after the player selects the selection buttons, controlling the information output interface to display the hidden contents hidden of the position-associated selection items, and determining whether a condition for ending the prize money game is satisfied to end the prize money game, the condition for ending the prize money game being when any of the at least one ending option is displayed by the information output interface;

d) accumulating by the accumulation process the reward displayed by the information output interface when the condition for ending the prize money game is not satisfied;

e) repeating steps (c) to (d) until the condition for ending the prize money game is satisfied; and f) after the prize money game ends, calculating and paying out the game prize money to the player through calculation of the prize money calculation and payout process according to the rewards accumulated in the accumulation process by the prize money calculation and payout process.

In implementation, the rewards are fundamentally, for example but not limited to, the accumulated prize money of the game prize money, prizes or services.

In other embodiments, according to application requirements, the rewards and the at least one ending option may also be defined as a plurality of multiple ratio rewards and at least one prize money level reward, a plurality of additional money bonuses and at least one prize money level reward, a plurality of points and at least one ending option, or a plurality of additional bonus symbols and at least one prize money level reward.

Accordingly, through the design of the selection buttons and the associated selection items, the present invention allows the player to see the selection items having the hidden contents. Without knowing the hidden contents beforehand, the player intuitively and randomly selects the selection buttons, and the hidden contents of the associated selection items are displayed once the selection buttons are selected. Thus, the player may intuitively play the prize money game without spending time on learning rules. The prize money game ends once the ending option is selected, thus ending the prize money game in a random manner. The above playing method in which the prize money game is ended at a random time point boosts the fun in playing the game. Further, as the selection items selected by the user are additional rewards, the attractiveness that the prize money game has on the player and the sense of expectation during the game are increased, thereby tempting more players to choose to play the entertainment system having a prize money game of the present invention.

DETAILED DESCRIPTION OF THE PREFERRED EMBODIMENTS

Figure 1:
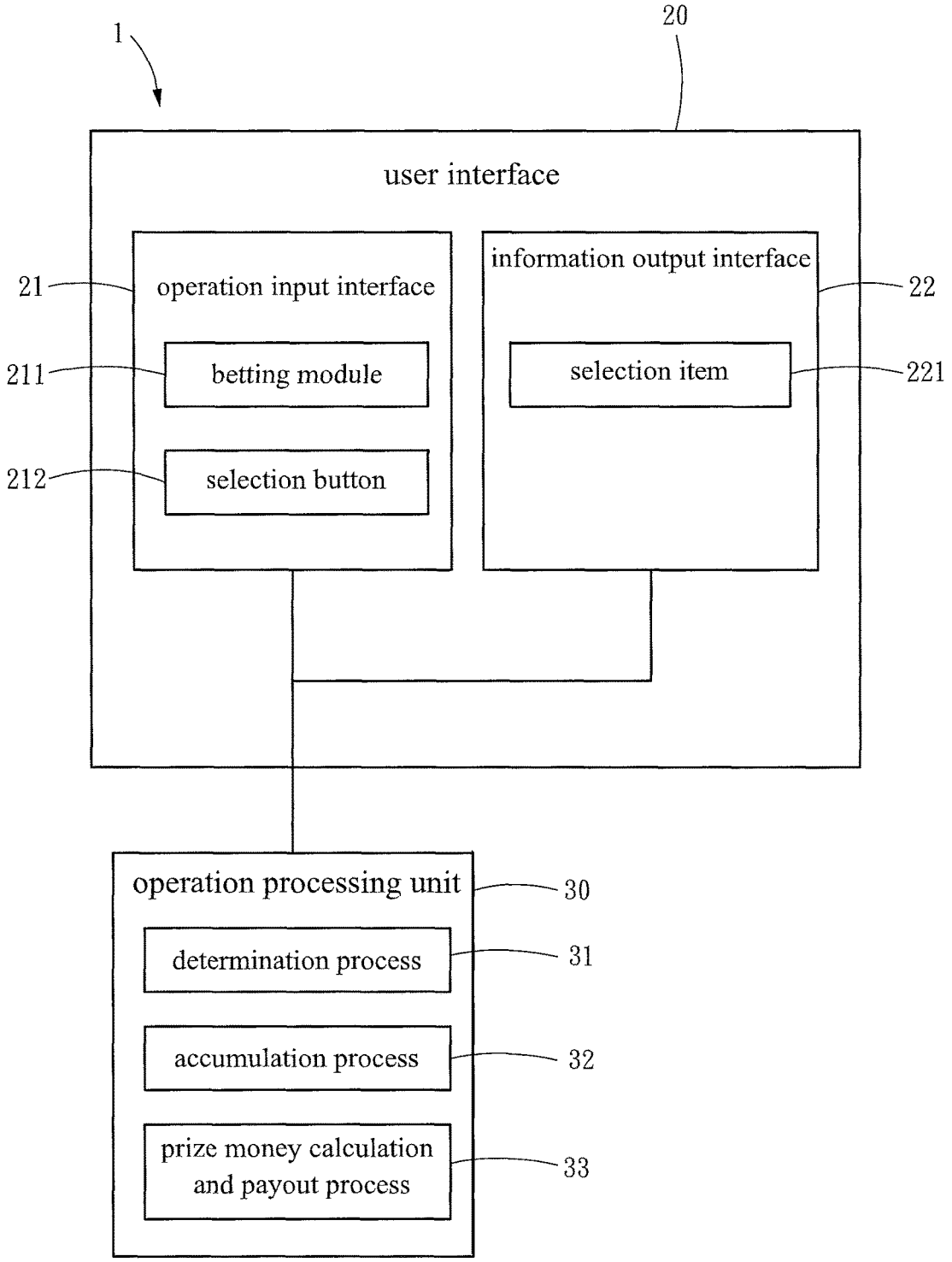
FIG. 1 is a diagram of a main system structure of an entertainment system of the present invention.

Details and technical contents of the present invention are given with the accompanying drawings in the embodiments below. It should be noted that, these non-limiting embodiments are examples for explaining the present invention, and are not to be construed as limitations to the present invention.

Referring to FIG. 1, FIG. 2 and FIG. 3A-D, FIG. 1 shows a diagram of a main system structure of the present invention, and FIG. 2 and FIG. 3A-D are schematic diagrams associated with a first embodiment of the present invention. The present invention provides an entertainment system 1 having a prize money game. A player is allowed to place a bet on the entertainment system 1, and to obtain game prize money after triggering the prize money game. The entertainment system 1 includes a user interface 20 and an operation processing unit 30.

The user interface 20 includes an operation input interface 21 and an information output interface 22. The operation input interface 21 includes a betting module 211 for the player to place a bet, and a plurality of selection buttons 212 for the player to play the prize money game. The information output interface 22 includes a plurality of selection items 221, which have identical appearances, hidden contents, and positions associated with the selection buttons 212.

Figure 2:
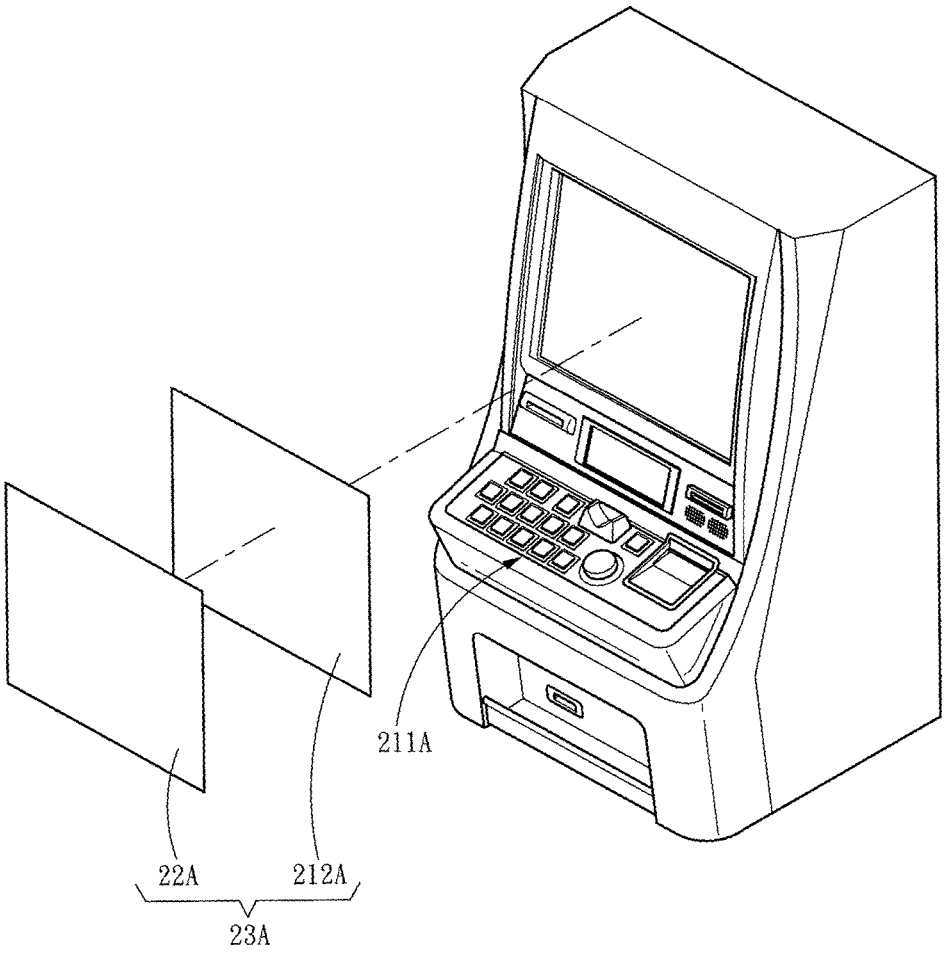
FIG. 2 is a schematic diagram of a partial structure of an entertainment system according to a first embodiment of the present invention.

According to a first embodiment of the present invention, as shown by the operation input interface 21 in FIG. 1 and FIG. 2, the betting module 211 for the player to place a bet is a physical key 211A (may be in a plural quantity in implementation), and the selection buttons 212 for the player to play the prize money game are disposed on a touch panel 212A. The information output interface 22 is an information output screen 22A overlapping the touch panel 212A, and the hidden contents of the selection items 221 are displayed on the information output screen 22A. The touch panel 212A and the information output screen 22A are combined into a touch screen 23A. In another embodiment, the user interface may be purely a touch screen (without the physical key 211A in FIG. 2). In this touch screen, the betting module and the selection buttons of the operation input interface may be concurrently achieved through a touch panel, and the information output interface is an information output screen overlapping the touch panel. Alternatively, in another embodiment, the operation input interface and the information output interface may be a physical key and a display screen that are separately disposed; that is, the betting module and the selections buttons are achieved by physical keys.

Figure 3A:
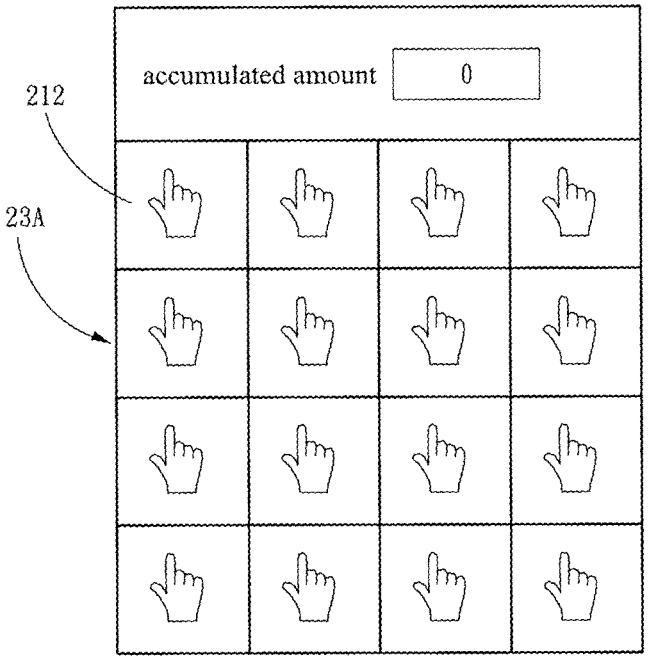
FIG. 3A to FIG. 3D are schematic diagrams of images according to the first embodiment of the present invention.
Figure 3B:
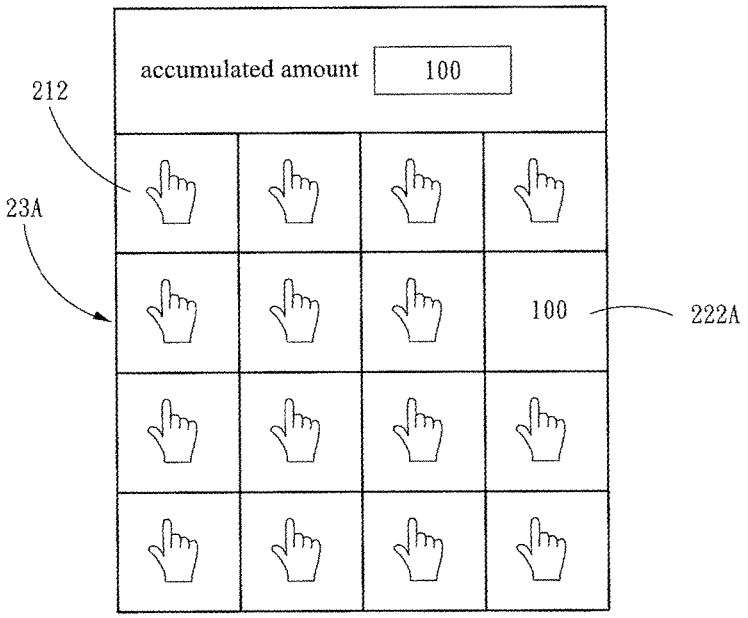
Figure 3C:
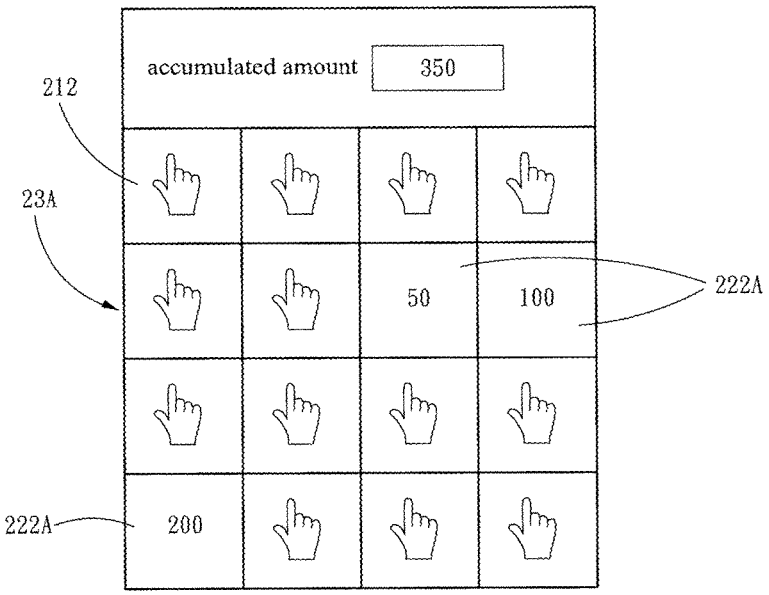
Figure 3D:
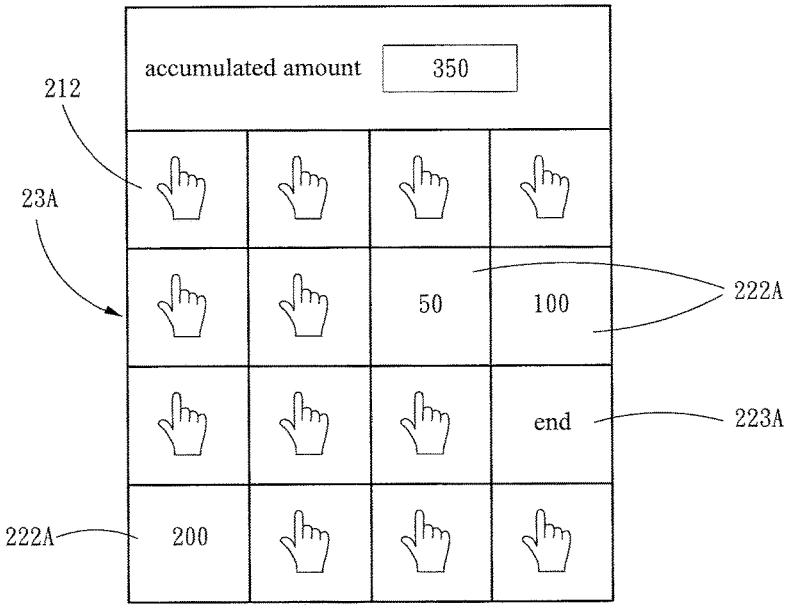

As shown in FIG. 1 and FIG. 3A-D, the operation processing unit 30 includes a determination process 31, an accumulation process 32 and a prize money calculation and payout process 33. The operation processing unit 30 performs steps (a)-(e). In step (a), the operation processing unit 30, determines by the determination process whether the prize money game is triggered, and defines the hidden contents of the selection items 221 to include a plurality of rewards 222A and at least one ending option 223A (as shown in FIG. 3D) after the prize money game is triggered. In this embodiment, the at least one ending option 223A is in a single quantity. It should be noted that, in other embodiments, the appearances of the selection items may be designed to be different.

In step (b), the operation processing unit 30 displays the selection items 221 on the information output interface 22, and provides the selection items 221 to and activates the selection buttons 212 at the operation input interface 21.

In step (c), after the player selects the selection buttons 212, the operation processing unit 30 controls the information output interface 22 to display the hidden contents of the position-associated selection buttons 212 (the hidden contents are any of the rewards 222A and the ending option 223A), and determines whether a condition for ending the prize money game is satisfied to end the prize money game. The condition for ending the prize money game is when the ending option 223A is displayed by the information output interface 22.

In step (d), when the condition for ending the prize money game is not satisfied, the operation processing unit 30 accumulates by the accumulation process 32 the rewards 222A that the information output interface 22 displays; that is, when the reward 222A is selected, it is accumulated by the accumulation process 32.

In step (e), steps (c) and (d) are repeated until the condition for ending the prize money game is satisfied. That is to say, when steps (c) and (d) are repeated, the accumulation process 32 sequentially accumulates the selected rewards 222A. In other words, in this embodiment, the player selects only one selection button 212 each time, and so the reward 222A currently selected is accumulated before the condition for ending the prize money game is satisfied.

In step (f), after the prize money game ends, the operation processing unit 30 calculates and pays out, by the prize money calculation and payout process 33, the prize money to the player, through the calculation of the prize money calculation and payout process 33 according to the rewards 222A the accumulation process 32 has accumulated. In an alternative application (not shown) of the embodiment, when rewards are non-prize money level rewards (e.g., prizes or services) or the ending option is directly selected, the game prize money is considered zero and no game prize money is provided. The selected prizes or services are directly deposited into an account of the player for the player to make an exchange.

To prevent the player from cracking and illegitimately learning the hidden contents of the selection items 221, the operation processing unit 30 may randomly select any of the rewards 222A and the ending option 223A as the hidden contents of the position-associated selection item 221. In other words, the hidden contents of the selection items 221 in fact appear randomly, so as to prevent the player from calculating and cheating. Further, the probability that the operation processing unit 30 selects the ending option 223A changes with the remaining number of the selection buttons 212 that are not yet selected. When only one last selection button 212 is left, the probability of selecting the ending option 223A at this point is 100%, so as to ensure the player to eventually select the ending option 223A to end the prize money game and to prevent system errors.

Further, to have the player be able to select the rewards, in an alternative application of the embodiment, the operation processing unit may incorporate the ending option into the selection range once the selected rewards reach a predetermined number. Further, to allow the player to repeatedly experience the excitement of an imminent ending, in an alternative application of the embodiment, the at least one ending option may be in a plural quantity, and the condition for ending the prize money game is satisfied only when a predetermined number of the ending positions are displayed by the information output interface; that is, the operation processing unit then only determines that the condition for ending the prize money game is satisfied to end the prize money game. For example, when the predetermined number is three, the prize money game ends only after the player has selected three ending options. It should be noted that, the predetermined number is preferably less than three to prevent the playing time from getting too long and affecting the interest of the player. Further, in such application, because the ending option may be repeatedly selected until the predetermined number is reached, the total number of the selection buttons may be appropriately increased through design to prevent an insufficient number of selection buttons.

Referring to FIG. 1 and FIG. 3A-D, to reward high-stake players, the operation processing unit 30 may individually determine whether the rewards 222A are to be used as hidden contents of the selection items 221 according to a bet amount that the player places on the entertainment system 1. In other words, predetermined rewards 222A may be designed to be accessible to only high-stake players, and can only be selected once the player places a bet that exceeds a predetermined value (set by a vendor as desired). In an alternative embodiment, a predetermined bet amount may be given a most substantial reward, so as to avoid the player from any adverse feeling that the vendor encourages players to place only maximum bet amounts.

For a player who selects a different "multifold bet" (directly calculating the bet amount by a predetermined multiple), the prize money calculation and payout process 33 may additionally calculate and add bet multiple prize money to the game prize money. Further, the bet multiple prize money is positively correlated with a multiple and the bet placed by the player. For example, as the multiple gets higher and the bet gets larger, the bet multiple prize money also gets larger, hence encouraging the player to increase the multiple and the bet. Similarly, in other embodiments, a predetermined multiple may be given with most substantial bet multiple prize money, so as to avoid the player from any adverse feeling that the vendor encourages only multifold bet players who place maximum bet multiples. It should be noted that, because the bet multiple of the player adopted is the bet multiple before the prize money game is triggered, the bet multiple prize money is determined at the time when the prize money game is triggered. Thus, the amount of the bet multiple prize money is displayed in advance while the player plays the prize money game, so as to enhance positive moods of the player playing the game.

Refer to FIG. 3A-D for actual operation images of the first embodiment of the present invention as well as FIG. 2. As previously described, in the operation input interface 21, the selection buttons 212 for the player to play the prize money game are disposed on the touch panel 212A, and the selection items 221 associated with the selection buttons 212 are displayed on the information output screen 22A. Because the touch panel 212A and the information output screen 22A are combined into the touch screen 23A, as shown in FIG. 3A, the player may freely choose which selection button 212 is to be selected on the touch screen 23A when playing the prize money game. At this point, the touch screen 23A displays hand images to represent the positions of the selection buttons 212. After selection is made by the player, the hand image of the touch screen 23A disappears, and the hidden contents of the selected selection item 221 become displayed on the touch screen 23A, the hidden contents may be the reward 222A after which another selection may be made, or the ending option 223A that ends the prize money game after being selected. As shown in FIG. 3B, the player selects the reward 222A, whose contents are prize money 100. At this point, the accumulation process 32 performs the accumulation, and displays 100 as an accumulated amount on the touch screen 23A. As shown in FIG. 3C, the player may continue selecting, and the rewards 222A selected are sequentially prize money 50 and 200. At this point, the accumulated amount is 350. As shown in FIG. 3D, when the ending option 223A ("end" is displayed) is selected, the prize money calculation and payout process 33 pays out the game prize money to the player according to the prize money (i.e., 350) of the rewards 222A that the accumulation process 32 has accumulated.

Refer to FIG. 1, FIG. 4, and FIG. 5A-D. FIG. 4 and FIG. 5A-D are a second embodiment of the present invention. Compared to the first embodiment, the hidden contents of the selection items 221 include a plurality of multiple ratio rewards 222B and a plurality of prize money level rewards 223B. The plurality of prize money level rewards 223B respectively have temporary prize money in different values. In another application of the embodiment, the prize money level rewards may be in a single quantity, and so the hidden contents include only a plurality of multiple ratio rewards and temporary prize money in one predetermined value.

Figure 4:
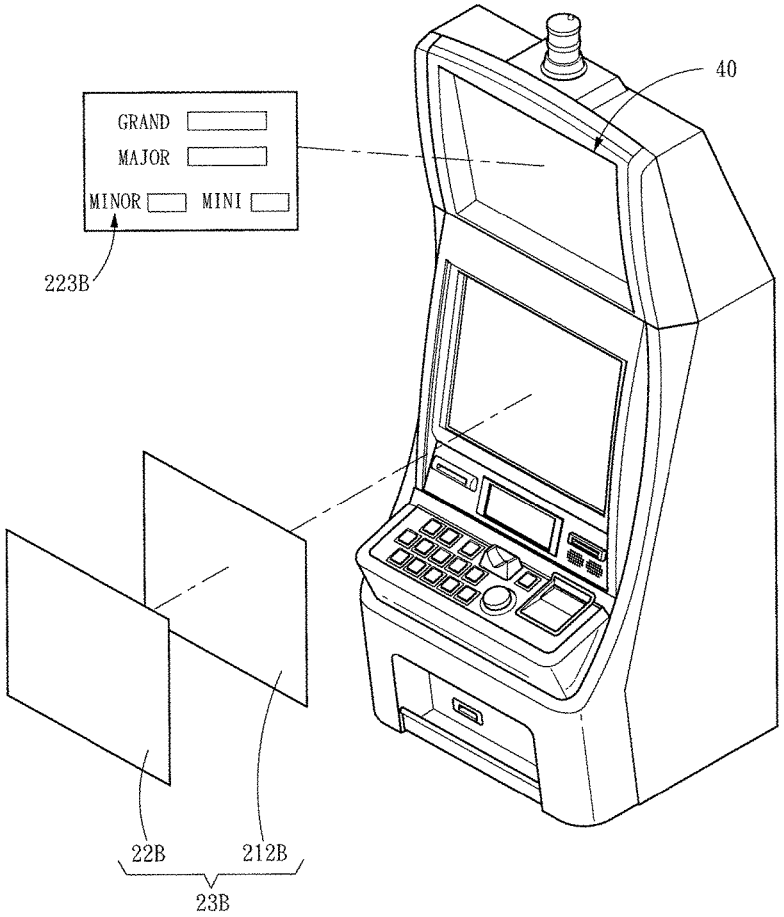
FIG. 4 is a schematic diagram of a partial structure of an entertainment system according to a second embodiment of the present invention.

As shown in FIG. 4, the entertainment system 1 of this embodiment further includes a prize money display board 40. The prize money display board 40 displays the temporary prize money of the plurality of prize money level rewards 223B, which may be divided into grand, major, minor and mini prizes; that is, the temporary prize money is in amounts of four different values.

The operation processing unit 30 controls the information output interface 22 to display the multiple ratio rewards 222B and the plurality of prize money level rewards 223B hidden in the position-associated selection items 221. When any of the plurality of prize money level rewards 223B is displayed by the information output interface 22, the operation processing unit 30 determines that the condition for ending the prize money game is satisfied and immediately ends the prize money game. The accumulation process 32 accumulates the values of the multiple ratio rewards 222B that the information output interface 22 displays as an additional extra ratio. After the prize money game ends, the prize money calculation and payout process 33 utilizes a product of the additional extra ratio and the temporary prize money of the prize money level reward 223B that leads to ending the prize money game as an addition amount. The temporary prize money is added with the additional amount as the game prize money that is then paid out to the player.

In the second embodiment, the values of the multiple ratio rewards 222B may be randomly generated within a predetermined range, e.g., randomly generated between 10% and 100%. Alternatively, the values of the multiple ratio rewards 222B are selected from a payout odds combination, which include numbers provided in advance, e.g., a numerical combination (10%, 10%, 20%, 20% and 100%) or (10%, 20%, 30%, 40% and 50%). The values of the multiple ratio rewards 222B may be partially the same or partially different, or may be entirely different.

Similar to the technical solution of the first embodiment, the operation processing unit 30 randomly selects any of the multiple ratio rewards 222B and the prize money level rewards 223B as the hidden contents of the selection item 221. Further, the probability that the operation processing unit 30 selects one of the prize money level rewards 223B changes according to the remaining number of the selection buttons 212 that are not yet selected. In another application (not shown) of the embodiment, the prize money level rewards are divided into several groups and have temporary prize money in different values. Further, only when a predetermined number of the prize money level rewards of the same group (i.e., the group with the same value) are displayed by the information output interface, the operation processing unit ends the prize money game. For example, assuming the predetermined number is three, when the player selects one grand prize or one minor prize after having selected two multiple ratio rewards, two grand prizes and two minor prizes, the prize money game is caused to end.

According to the bet amount that the player places on the entertainment system 1, the operation processing unit 30 may individually determine whether the multiple ratio rewards 222B and the prize money level rewards 223B are to be used as the hidden contents of the selection item 221. For example, when the bet amount that the player places is a predetermined value, the probability of selecting the multiple ratio rewards of a predetermined group is the highest, or the probability of selecting predetermined prize money level rewards is the highest. Alternatively, the operation processing unit 30 may first determine the prize money level rewards according to the bet amount, and extendedly determine the multiple ratio rewards of the corresponding payout odds combination accordingly.

As described in the previous embodiment, the prize money calculation and payout process 33 additional calculates and adds bet multiple prize money to the game prize money according to the bet of the multiple the player selects. Further, the bet multiple prize money is positively correlated with the multiple and the bet placed by the player. Similarly, in another application of the embodiment, a predetermined multiple may be given most substantial bet multiple prize money, so as to avoid the player from any adverse feeling that the vendor encourages only multifold bet players who place maximum bet multiples.

As shown in FIG. 4, similar to the approach of the previous embodiment, in this embodiment, the selection buttons 212 of the operation input interface 21 are disposed on a touch panel 212B. The information output interface 22 is an information output screen 22B overlapping the touch panel 212B. The hidden contents of the selection items 221 are displayed on the information output screen 22B. The touch panel 212B and the information output screen 22B are combined into a touch screen 23B.

Figure 5A:
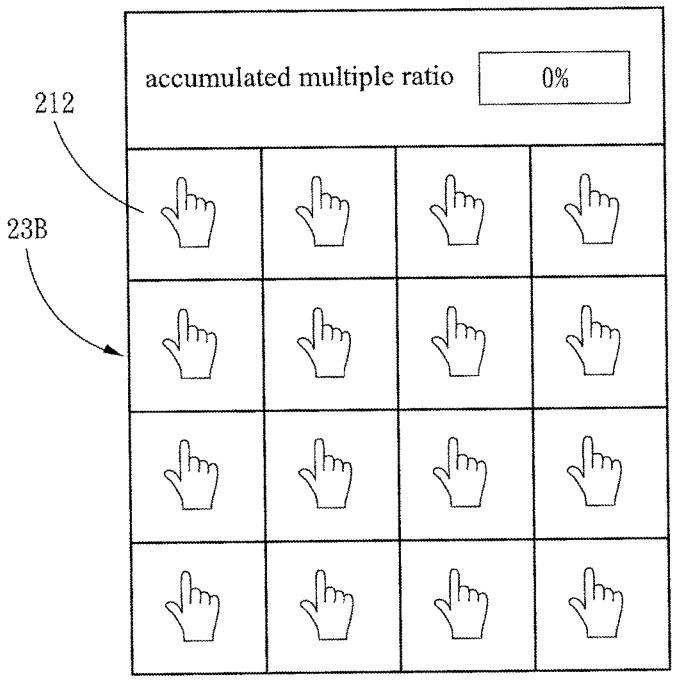
FIG. 5A to FIG. 5D are schematic diagrams of images according to the second embodiment of the present invention.
Figure 5B:
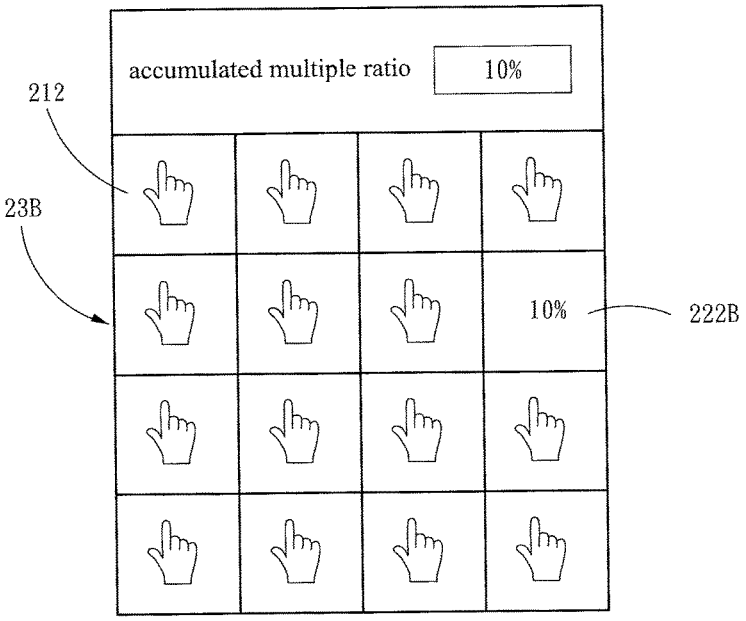
Figure 5C:
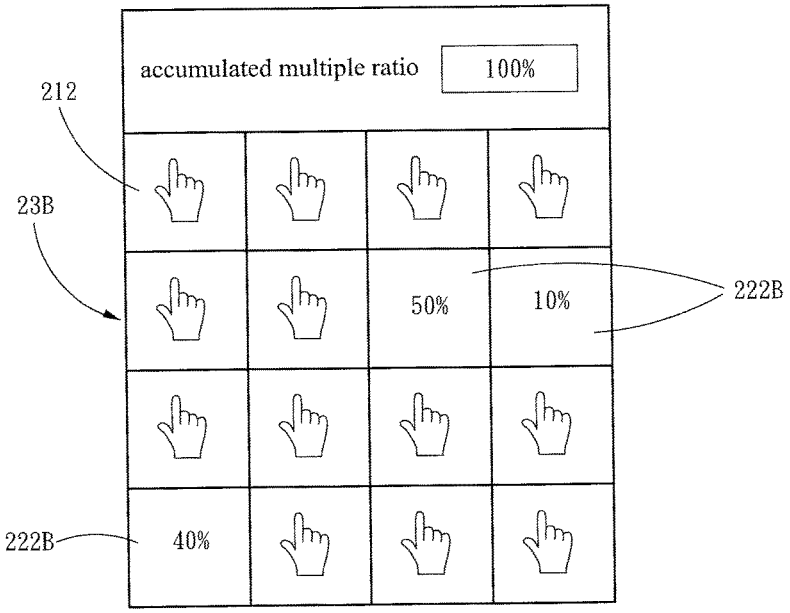
Figure 5D:
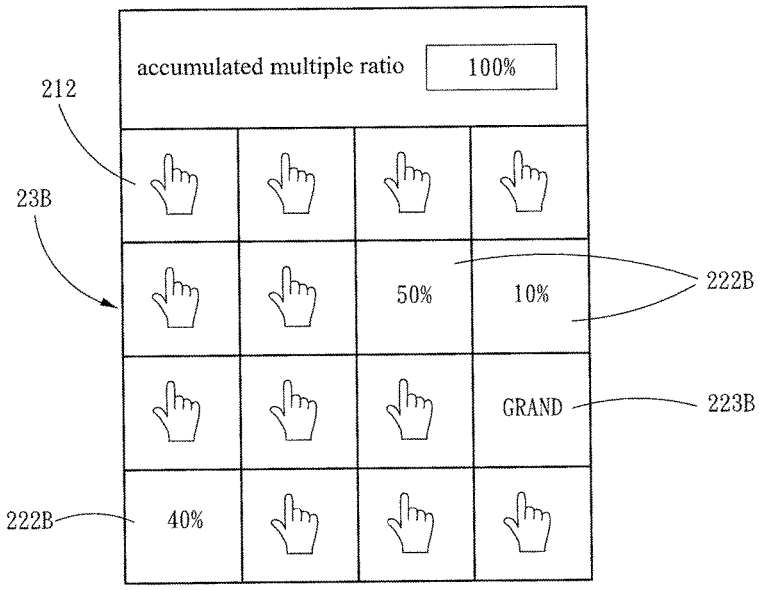

Refer to FIG. 5A-D showing schematic diagrams of images according to the second embodiment, as well as FIG. 4. As shown in FIG. 5A, to play the prize money game, the player may freely choose which of the selection buttons 212 is to be selected on the touch screen 23B. After the selection, the hidden contents of the selected selection item 221 are displayed on the touch screen 23B, and may be the multiple ratio reward 222B after which another selection may be made, or one of the prize money level rewards 223B that leads to ending the prize money game. FIG. 5B shows that the player has selected the multiple ratio reward 222B, whose contents are a multiple ratio of 10%. At this point, the accumulation process 32 performs accumulation, and displays 10% as an accumulated multiple ratio on the touch screen as the addition extra ratio. As shown in FIG. 5C, the player may continue the selection, and the multiple ratio rewards 222B sequentially selected are ratios of 50% and 40%. At this point, the accumulated multiple ratio is 100%. As shown in FIG. 5D, when the prize money level reward 223B is selected, e.g., when the "grand" prize is selected, the prize money calculation and payout process 33 utilizes a product of the additional extra ratio (the accumulated multiple ratio of 100%) and the temporary prize money (the grand prize) of the prize money level reward 223B that leads to ending the prize money game as an addition amount. The temporary prize money is added with the additional amount as the game prize money that is then paid out of the player.

Figure 6:
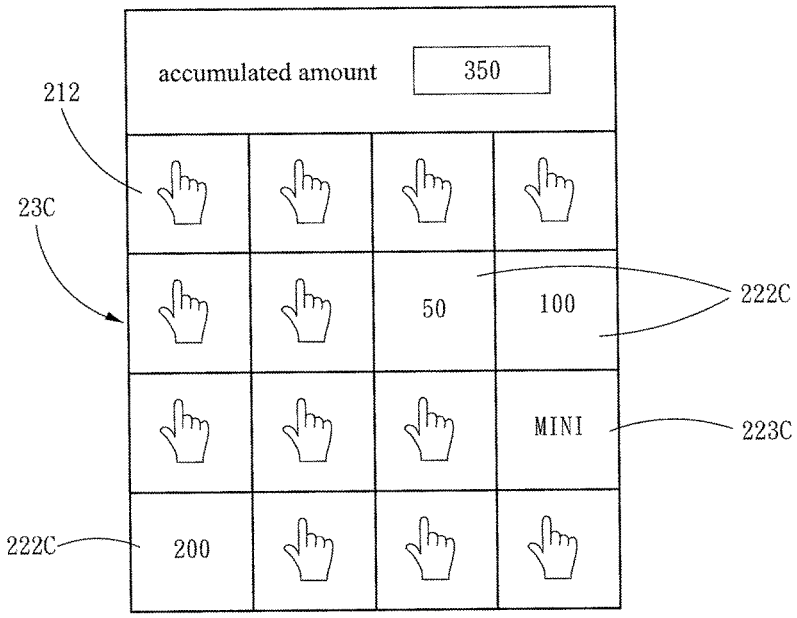
FIG. 6 is a schematic diagram of an image according to a third embodiment of the present invention.

Referring to FIG. 1 and FIG. 6, FIG. 6 shows an actual operation image according to a third embodiment of the present invention. Compared to the second embodiment, the hidden contents of the selection items 212 include a plurality of additional money bonuses 222C and a plurality of prize money level rewards 223C. After the player selects the selection buttons 212, the operation processing unit 30 controls the information output interface 22 (the information output interface is disposed in a touch screen 23C in this embodiment) to display one of the additional money bonuses 222C (prize money 50, 100 and 200 shown in the diagram) and the prize money level rewards 223C (a prize money level reward "mini" shown in the diagram) hidden in the position-associated selection items 221. That is, the multiple ratio rewards 222B in the second embodiment are replaced by the addition money bonuses 222C. In another application of the embodiment, the prize money level rewards may be in a single quantity, and so the hidden contents include only a plurality of multiple ratio rewards and one prize money level reward in a predetermined value.

The accumulation process 32 accumulates the values of the addition money bonuses 222C that the information output interface 22 displays as an additional extra money bonus, and displays 350 as an accumulated amount on the information output interface 22 (the information output interface is disposed in the touch screen 23C in this embodiment). After the prize money game ends, the prize money calculation and payout process 33 utilizes a sum of the additional extra money bonus and the value of the temporary prize money of the prize money level reward 223C that leads to ending the prize money game as the game prize money, which is then paid out to the player. Other details of this embodiment are identical to those of the foregoing embodiments, and shall be omitted herein.

Figure 7:
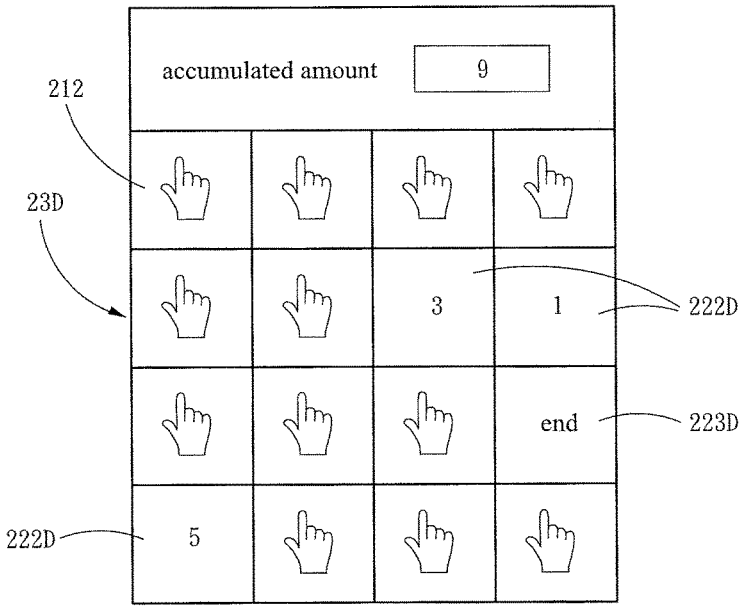
FIG. 7 is a schematic diagram of an image according to a fourth embodiment of the present invention.

Referring to FIG. 1 and FIG. 7, FIG. 7 shows a schematic diagram of an image according to a fourth embodiment of the present invention. Compared to the first embodiment, the game prize money is any selected from a plurality of prize money level rewards, which respectively have temporary prize money in different values. The hidden contents of the selection items 221 include a plurality of points 222D and an ending option 223D. In this embodiment, the rewards 222A of the first embodiment are replaced by the points 222D, and the operation processing unit 30 controls the information output interface 22 (the information output interface is disposed in a touch screen 23D in this embodiment) to display the points (points 1, 3 and 5 shown in the diagram) and the ending option 223D hidden in the position-associated selection items 221. The accumulation process 32 accumulates the points 222D the information output interface 22 (the information output interface is disposed in the touch screen 23D in this embodiment) displays, and displays 9 as an accumulated value on the information output interface 22D. After the prize money game ends, the prize money calculation and payout process 33 determines the value of the temporary prize money of which prize money level reward is to be selected as the game prize money, which is then paid out to the player. For example, the "grand" prize is selected when the accumulated value of the points is more than 20, the "major" prize is selected when the accumulated value is between 10 and 19, the "minor" prize is selected when the accumulated value is between 5 and 9, and the "mini" prize is selected when the accumulated value is between 0 and 4.

The values of the points 222D may be randomly generated from values within a predetermined range. Alternatively, the values of the points 222D are selected from a numerical combination, which includes numbers provided in advance. Further, the different values of the points 222D may be represented by images, e.g., different numbers of stacked gold ingots are used to represent the values.

In this embodiment, the ending option 223A may be in a single quantity. In another application of the embodiment, multiple ending options may be disposed in the selection items. Similarly, other details of this embodiment are identical to those of the foregoing embodiments, and shall be omitted herein.

Figure 8:
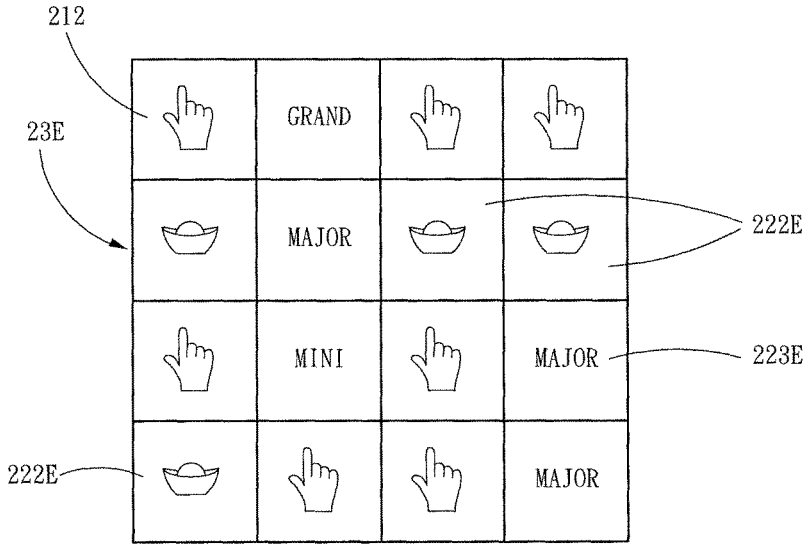
FIG. 8 is a schematic diagram of an image according to a fifth embodiment of the present invention.

Refer to FIG. 8 showing a fifth embodiment of the present invention. Compared to the second embodiment, the hidden contents of the selection items 221 include a plurality of additional bonus symbols 222E and a plurality of prize money level rewards 223E; that is, the multiple ratio rewards 222B in the second embodiment are replaced by the additional bonus symbols 222E. For example, the additional bonus symbols 222E may be symbols of "gold ingots". The accumulation process 32 accumulates the number of the additional bonus symbols 222E the information output interface 22 displays, and determines whether to add an additional extra money bonus. That is, when the number of the additional bonus symbols 222E exceeds a predetermined number (e.g., three gold ingots in FIG. 8), the additional extra money bonus is added. Further, the additional extra money bonus is positively correlated with the temporary prize money—the additional extra money bonus gets larger as the temporary prize money increases.

Further, in this embodiment, when a predetermined number of the prize money level rewards 223E (three in this embodiment) in the same group are displayed by the information output interface 22 (the information output interface is disposed in a touch screen 23E in this embodiment), the prize money game ends. After the prize money game ends, the prize money calculation and payout process 33 utilizes a sum of the additional extra money bonus and the value of the temporary prize money of the prize money level reward 223E that leads to ending the prize money game as the game prize money, which is then paid out to the player. As shown in FIG. 8, there are one "grand" prize, three "major" prizes, and one "mini" prize. Thus, the temporary prize money of the major prize is added with the additional extra money bonus corresponding to the major prize as the game prize money.

Figure 9:
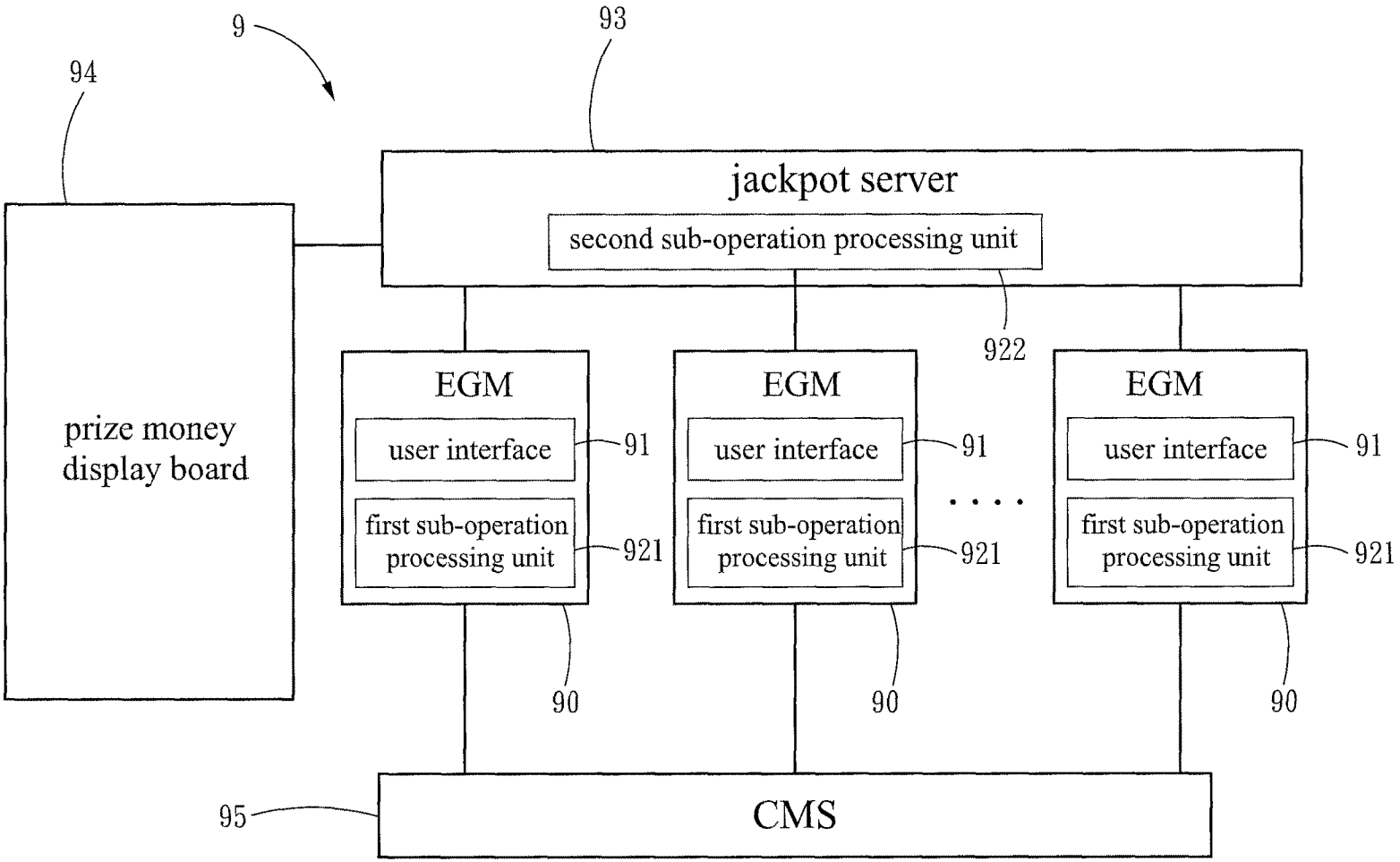
FIG. 9 is a schematic diagram of a system structure of the present invention in a multi-user application.

FIG. 9 shows a schematic diagram of a structure of an entertainment system 9 in a multi-player application. Referring to FIG. 9, in the entertainment system 9, a plurality of electronic gaming machines (EGM) 90 are provided with a plurality of corresponding user interfaces 91, respectively. Operation processing units include a first sub-operation processing unit 921 and a second sub-operation processing unit 922. The first sub-operation processing unit 921 includes a determination process (not shown), and the second sub-operation processing unit 922 includes an accumulation process and a prize money calculation and payout process (not shown). The first sub-operation processing unit 921 is electrically disposed in the electronic gaming machine 90, and the second sub-operation processing unit 922 is electrically disposed in a jackpot server 93. The jackpot server 93 is connected to a prize money display board 94 to accordingly display associated information of the prize money game. To better integrate information such as membership information, point records and rebate points of players, the electronic gaming machines 90 are further electrically connected to a casino management system (CMS) 95. Such architecture allows multiple players to play simultaneously to save set-up costs. Further, the prize money can be accumulated quickly with multiple players playing simultaneously to further rapidly increase the amount displayed by the prize money display board 94, thereby enhancing the attractiveness of game playing.

The user interface and the operation processing unit of the above architecture may be applied to the foregoing embodiments and applications, and associated operation details are omitted herein. Further, the operation processing unit may be integrated in the jackpot server instead of being divided into two parts.

Figure 10:
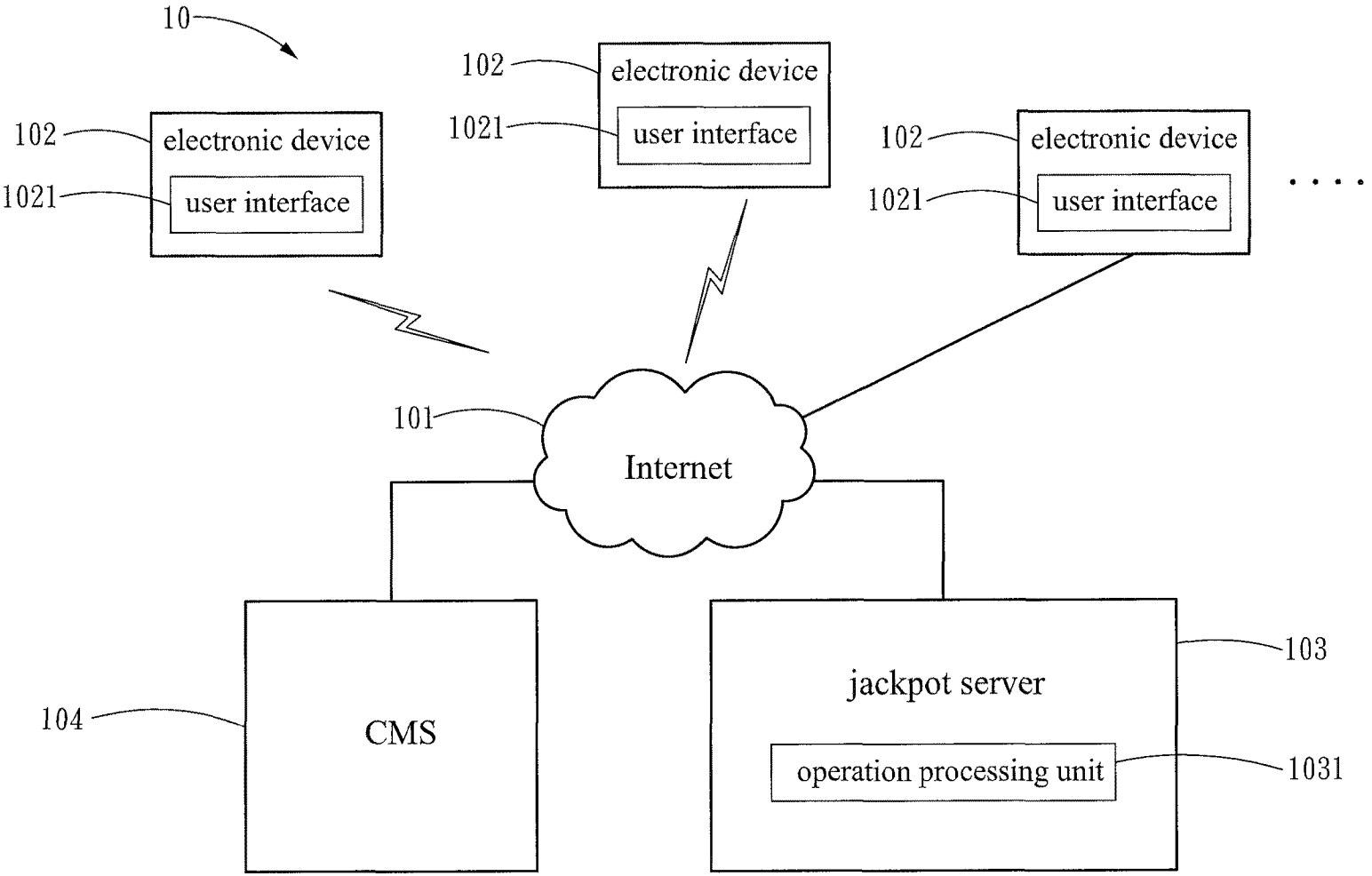
FIG. 10 is a schematic diagram of a system structure of the present invention in a remote-end application.

FIG. 10 shows a schematic diagram of a structure of an entertainment system 10 of the present invention in a remote-end application. The components of the entertainment system 10 are connected through an Internet 101 (in a wired or wireless manner). More specifically, a plurality of players at a remote end may use electronic devices 102 comprising touch screens, such as touch computers, tablet computers and smart phones, and play games by operation user interfaces 1021 in the electronic devices 102. The user interface 1021 allows a player to place a bet, provides selection buttons for the player to select, and displays selection items. The electronic device 102 at a remote end is connected to a jackpot server 103 and a CMS 104. The jackpot server 103 is provided with an operation processing unit 1031 to perform a determination process, an accumulation process and a prize money calculation and payout process. Using the above architecture, the convenience of no boundaries of the Internet may be fully exercised to increase the player's will in playing.

As described, by disposing the user interface including a plurality of selection buttons, the present invention allows a player to freely select the plurality of selection buttons. After the plurality of selection buttons are selected by the user, an option allowing continual selection or an option that ends the prize money game may be selected. The entertainment system of the present invention may be operated intuitively without having to learn rules in advance, and provides a playing method similar to a lottery draw that yields an uncertain outcome, thereby offering the player with the pleasure of ending the prize money game at random time points. Further, because the selection time selected by the user is an additional reward, the attractiveness of the prize money game upon the player as well as the sense of expectation during the gaming process are increased, thereby tempting more players to choose to play the entertainment system having a prize money game of the present invention.

What is claimed is:

1. An entertainment system having a prize money game, for a player to place a bet on the entertainment system and to obtain game prize money after triggering the prize money game, comprising:

a user interface, comprising an operation input interface and an information output interface, the operation input interface comprising a betting module for the player to place the bet and a plurality of selection buttons for the player to play the prize money game, the information output interface comprising a plurality of selection items comprising hidden contents and positions associated with the selection buttons; and an operation processing unit, electrically connected to the operation input interface and the information output interface, comprising a determination process, an accumulation process and a prize money calculation and payout process, the operation processing unit performing steps of:

a) determining by the determination process whether the prize money game is triggered, and defining the hidden contents of the selection items to include a plurality of rewards and at least one ending option after the prize money game is triggered;

b) displaying the selection items on the information output interface, and activating the selection buttons at the operation input interface;

c) when the selection button is selected by the player, the operation processing unit randomly selects any of the rewards and the at least one ending option as the hidden contents of the position-associated selection item, and a probability that the operation processing unit selects the ending operation changes according to a remaining number of the selection buttons that are not yet selected; after the player selects the selection buttons, controlling the information output interface to display the hidden contents of the position-associated selection items, and determining whether a condition for ending the prize money game is satisfied to end the prize money game, the condition for ending the prize money game being when any of the at least one ending option is displayed by the information output interface;

d) when the condition for ending the prize money game is not satisfied, accumulating by the accumulation process the rewards that the information output interface displays;

e) repeating steps (c) and (d) until the condition for ending the prize money game is satisfied; and f) after the prize money game ends, calculating and paying out the game prize money to the player through calculation of the prize money calculation and payout process according to the rewards that the accumulation process has accumulated by the prize money calculation and payout process.

2. The entertainment system having a prize money game of claim 1, wherein when the rewards selected by the operation processing units reach a predetermined number, the at least one ending option is incorporated into a selection range.

3. The entertainment system having a prize money game of claim 1, wherein the at least one ending option is in a plural quantity, and the condition for ending the prize money game is satisfied when a predetermined number of the ending options are displayed by the information output interface.

4. The entertainment system having a prize money game of claim 1, wherein the operation processing unit individually determines whether the rewards are to be used as the hidden contents of the selection items according to a bet amount that the player places on the entertainment system.

5. The entertainment system having a prize money game of claim 1, wherein the prize money calculation and payout process additionally calculates and adds bet multiple prize money to the game prize money, and the bet multiple prize money is positively correlated with a multiple and the bet placed by the player.

6. An entertainment system having a prize money game, for a player to place a bet on the entertainment system and to obtain game prize money after triggering the prize money game, comprising:

a user interface, comprising an operation input interface and an information output interface, the operation input interface comprising a betting module for the player to place the bet and a plurality of selection buttons for the player to play the prize money game, the information output interface comprising a plurality of selection items comprising hidden contents and positions associated with the selection buttons; and an operation processing unit, electrically connected to the operation input interface and the information output interface, comprising a determination process, an accumulation process and a prize money calculation and payout process, the operation processing unit performing steps of:

a) determining by the determination process whether the prize money game is triggered, and defining the hidden contents of the selection items to include a plurality of multiple ratio rewards and at least one prize money level reward after the prize money game is triggered, the at least one prize money level reward respectively comprising temporary prize money in different values;

b) displaying the selection items on the information output interface, and activating the selection buttons at the operation input interface;

c) when the selection button is selected by the player, the operation processing unit randomly selects any of the multiple ratio rewards and the at least one prize money level reward as the hidden contents of the position-associated selection item, and a probability that the operation processing unit selects the at least one prize money level reward changes according to a remaining number of the selection buttons that are not yet selected; after the player selects the selection buttons, controlling the information output interface to display the hidden contents of the position-associated selection items, and determining whether a condition for ending the prize money game is satisfied to end the prize money game, the condition for ending the prize money game being when any of the at least one prize money level reward is displayed by the information output interface;

d) when the condition for ending the prize money game is not satisfied, accumulating by the accumulation process values of the multiple ratio rewards that the information output interface displays as an additional extra ratio;

e) repeating steps (c) and (d) until the condition for ending the prize money game is satisfied; and f) after the prize money game ends, utilizing a product of the additional extra ratio and the temporary prize money of the prize money level reward that leads to ending the prize money game as an addition amount, adding the temporary prize money with the additional amount as the game prize money, and paying out the game prize money to the player by the prize money calculation and payout process.

7. The entertainment system having a prize money game of claim 6, wherein values of the multiple ratio rewards are generated randomly within a predetermined range.

8. The entertainment system having a prize money game of claim 6, wherein values of the multiple ratio rewards are selected from a payout odds combination, which includes numbers given in advanced.

9. The entertainment system having a prize money game of claim 6, wherein the at least one prize money level reward is in a plural quantity, the plurality of prize money level rewards are divided into multiple groups and respectively have temporary prize money in different values, and the condition for ending the prize money game is satisfied when a predetermined number of the prize money level rewards of the same group are displayed by the information output interface.

10. The entertainment system having a prize money game of claim 6, wherein the operation processing unit individually determines whether the multiple ratio rewards and the at least one prize money level reward are to be used as the hidden contents of the selection items according to an amount of the bet that the player places on the entertainment system.

11. The entertainment system having a prize money game of claim 6, wherein the prize money calculation and payout process additionally calculates and adds bet multiple prize money to the game prize money, and the bet multiple prize money is positively correlated with a multiple and the bet placed by the player.

12. An entertainment system having a prize money game, for a player to place a bet on the entertainment system and to obtain game prize money after triggering the prize money game, comprising:

a user interface, comprising an operation input interface and an information output interface, the operation input interface comprising a betting module for the player to place the bet and a plurality of selection buttons for the player to play the prize money game, the information output interface comprising a plurality of selection items having hidden contents and positions associated with the selection buttons; and an operation processing unit, electrically connected to the operation input interface and the information output interface, comprising a determination process, an accumulation process and a prize money calculation and payout process, the operation processing unit performing steps of:

a) determining by the determination process whether the prize money game is triggered, and defining the hidden contents of the selection items to include a plurality of additional money bonuses and at least one prize money level reward after the prize money game is triggered, the at least one prize money level reward respectively having temporary prize money in different values;

b) displaying the selection items on the information output interface, and activating the selection buttons at the operation input interface;

c) when the selection button is selected by the player, the operation processing unit randomly selects any of the additional money bonuses and the at least one size money level reward as the hidden contents of the selection item, and a probability that the operation processing unit selects the at least one prize money level reward changes according to a remaining number of the selection buttons that are not yet selected; after the player selects the selection buttons, controlling the information output interface to display the hidden contents of the position-associated selection items, and determining whether a condition for ending the prize money game is satisfied to end the prize money game, the condition for ending the prize money game being when any of the at least one prize money level reward is displayed by the information output interface;

d) when the condition for ending the prize money game is not satisfied, accumulating by the accumulation process values of the additional money bonuses that the information output interface displays as an additional extra money bonus;

e) repeating steps (c) and (d) until the condition for ending the prize money game is satisfied; and f) after the prize money game ends, utilizing a sum of the additional extra money bonus and the value of the temporary prize money of the prize money level reward that leads to ending the prize money game as the game prize money, and paying out the game prize money to the player by the prize money calculation and payout process.

13. The entertainment system having a prize money game of claim 12, wherein the at least one prize money level reward is in a plural quantity, the plurality of prize money level rewards are divided into multiple groups and respectively have temporary prize money in different values, and the condition for ending the prize money game is satisfied when a predetermined number of the prize money level rewards of the same group are displayed by the information output interface.

14. The entertainment system having a prize money game of claim 12, wherein the operation processing unit individually determines whether the additional money bonuses and the at least one prize money level reward are to be used as the hidden contents of the selection items according to an amount of the bet that the player places on the entertainment system.

15. The entertainment system having a prize money game of claim 12, wherein the prize money calculation and payout process additionally calculates and adds bet multiple prize money to the game prize money, and the bet multiple prize money is positively correlated with a multiple and the bet placed by the player.

16. An entertainment system having a prize money game, for a player to place a bet on the entertainment system and to obtain game prize money after triggering the prize money game, the game prize money being any selected from a plurality of prize money level rewards, the plurality of prize money level rewards respectively having temporary prize money in different values, the entertainment system comprising:

a user interface, comprising an operation input interface and an information output interface, the operation input interface comprising a betting module for the player to place the bet and a plurality of selection buttons for the player to play the prize money game, the information output interface comprising a plurality of selection items having hidden contents and positions associated with the selection buttons; and an operation processing unit, electrically connected to the operation input interface and the information output interface, comprising a determination process, an accumulation process and a prize money calculation and payout process, the operation processing unit performing steps of:

a) determining by the determination process whether the prize money game is triggered, and defining the hidden contents of the selection items to include a plurality of points and at least one ending option after the prize money game is triggered;

b) displaying the selection items on the information output interface, and activating the selection buttons at the operation input interface;

c) when the selection button is selected by the player, the operation processing unit randomly selects any of the points and the at least one ending option as the hidden contents of the selection item, and a probability that the operation processing unit selects the at least one ending option changes according to a remaining number of the selection buttons that are not yet selected; after the player selects the selection buttons, controlling the information output interface to display the hidden contents of the position-associated selection items, and determining whether a condition for ending the prize money game is satisfied to end the prize money game, the condition for ending the prize money game being when any of the at least one ending option is displayed by the information output interface;

d) when the condition for ending the prize money game is not satisfied, accumulating by the accumulation process the points that the information output interface displays;

e) repeating steps (c) and (d) until the condition for ending the prize money game is satisfied; and f) after the prize money game ends, determining the value of the temporary prize money of which prize money level reward is to be selected as the game prize money and paying out the game prize money to the player by the prize money calculation and payout process.

17. The entertainment system having a prize money game of claim 16, wherein the at least one ending option is in a plural quantity, and the condition for ending the prize money game is satisfied when a predetermined number of the ending options are displayed by the information output interface.

18. The entertainment system having a prize money game of claim 16, wherein values of the points are randomly generated from values within a predetermined range.

19. The entertainment system having a prize money game of claim 16, wherein values of the points are selected from a numerical combination, which includes numbers given in advance.

20. The entertainment system having a prize money game of claim 16, wherein different values of the points are represented by images.

21. The entertainment system having a prize money game of claim 16, wherein the operation processing unit individually determines whether the points are to be used as the hidden contents of the selection items according to an amount of the bet that the player places on the entertainment system.

22. The entertainment system having a prize money game of claim 16, wherein the prize money calculation and payout process additionally calculates and adds bet multiple prize money to the game prize money, and the bet multiple prize money is positively correlated with a multiple and the bet placed by the player.

23. An entertainment system having a prize money game, for a player to place a bet on the entertainment system and to obtain game prize money after triggering the prize money game, comprising:

a user interface, comprising an operation input interface and an information output interface, the operation input interface comprising a betting module for the player to place the bet and a plurality of selection buttons for the player to play the prize money game, the information output interface comprising a plurality of selection items having hidden contents and positions associated with the selection buttons; and an operation processing unit, electrically connected to the operation input interface and the information output interface, comprising a determination process, an accumulation process and a prize money calculation and payout process, the operation processing unit performing steps of:

a) determining by the determination process whether the prize money game is triggered, and defining the hidden contents of the selection items to include a plurality of additional bonus symbols and at least one prize money level reward after the prize money game is triggered, the at least one prize money level reward respectively having temporary prize money in different values;

b) displaying the selection items on the information output interface, and activating the selection buttons at the operation input interface;

c) when the selection button is selected by the player, the operation processing unit randomly selects any of the additional bonus symbols and the at least one prize money level reward as the hidden contents of the selection item, and a probability that the operation processing unit selects the at least one prize money level reward changes according to a remaining number of the selection buttons that are not yet selected; after the player selects the selection buttons), controlling the information output interface to display the hidden contents of the position-associated selection items, and determining whether a condition for ending the prize money game is satisfied to end the prize money game, the condition for ending the prize money game being when any of the at least one prize money level reward is displayed by the information output interface;

d) when the condition for ending the prize money game is not satisfied, accumulating by the accumulation process the number of the additional bonus symbols that the information output interface displays;

e) repeating steps (c) and (d) until the condition for ending the prize money game is satisfied; and f) determining whether to add an additional extra money bonus according to the accumulated number of additional bonus symbols, the additional extra money bonus being positively correlated with the temporary prize money; after the prize money game ends, utilizing a sum of the additional extra money bonus and the value of the temporary prize money of the prize money level reward that leads to ending the prize money game as the game prize money, and paying out the game prize money to the player by the prize money calculation and payout process.

24. The entertainment system having a prize money game of claim 23, wherein the at least one prize money level reward is in a plural quantity, the plurality of prize money level rewards are divided into multiple groups and respectively have temporary prize money in different values, and the condition for ending the prize money game is satisfied when a predetermined number of the prize money level rewards of the same group are displayed by the information output interface.

25. The entertainment system having a prize money game of claim 23, wherein the prize money calculation and payout process additionally calculates and adds bet multiple prize money to the game prize money, and the bet multiple prize money is positively correlated with a multiple and the bet placed by the player.

26. The entertainment system having a prize money game of claim 23, wherein the operation processing unit individually determines whether the additional bonus symbols and the at least one prize money level reward are to be used as the hidden contents of the selection items according to an amount of the bet that the player places on the entertainment system.

* * * * *